US011445761B2

(12) United States Patent
Fu

(10) Patent No.: US 11,445,761 B2
(45) Date of Patent: Sep. 20, 2022

(54) METHOD FOR CONTROLLING THE OUTPUT POWER OF A POWER SUPPLY OF ELECTRONIC CIGARETTE AND ELECTRONIC CIGARETTE

(71) Applicant: SHENZHEN RELX TECHNOLOGY CO., LTD., Shenzhen (CN)

(72) Inventor: Yao Fu, Shenzhen (CN)

(73) Assignee: SHENZHEN RELX TECHNOLOGY CO., LTD., Shenzhen (CN)

( * ) Notice: Subject to any disclaimer, the term of this patent is extended or adjusted under 35 U.S.C. 154(b) by 437 days.

(21) Appl. No.: 16/736,926

(22) Filed: Jan. 8, 2020

(65) Prior Publication Data

US 2020/0221779 A1 Jul. 16, 2020

(30) Foreign Application Priority Data

Jan. 11, 2019 (CN) ..... 201910028649.7

(51) Int. Cl.

*A24F 47/00* (2020.01)
*A24F 40/50* (2020.01)
*A24F 40/40* (2020.01)

(52) U.S. Cl.

CPC ..... *A24F 40/50* (2020.01); *A24F 40/40* (2020.01)

(58) Field of Classification Search

CPC ..... A24F 40/50
See application file for complete search history.

(56) References Cited

U.S. PATENT DOCUMENTS

2018/0042308 A1* 2/2018 Takeuchi ..... A24F 40/60
2018/0325181 A1* 11/2018 Liu ..... A24F 40/57
2020/0154788 A1* 5/2020 Novak, III ..... G01L 13/00

* cited by examiner

*Primary Examiner* — Eric Yaary
(74) *Attorney, Agent, or Firm* — Idea Intellectual Limited; Margaret A. Burke; Sam T. Yip

(57) ABSTRACT

The present application provide a method for controlling the output power of a power supply of an electronic cigarette and an electronic cigarette, including following steps: controlling the power supply to output a first power P1 in a first time period in a first inhalation airflow flowing process, and to output a second power P2 in a subsequent second time period, where P1>P2; continuously detecting inhalation airflow; controlling the power supply to output a third power P3 in the inhalation airflow flowing process, where P1>P3; controlling the power supply to output the first power P1 in the first time period in the inhalation airflow flowing process, and to output the second power P2 in the second time period, where P1>P2; controlling the power supply to stop outputting power. According to the method of present application, energy consumption is slow, and aerosols are generated uniformly.

20 Claims, 2 Drawing Sheets

METHOD FOR CONTROLLING THE OUTPUT POWER OF A POWER SUPPLY OF ELECTRONIC CIGARETTE AND ELECTRONIC CIGARETTE

CROSS REFERENCE TO RELATED APPLICATIONS

The present application claims the benefit of priority from the China Patent Application No. 201910028649.7, filed on 11 Jan. 2019, the disclosure of which is hereby incorporated by reference in its entirety.

BACKGROUND

1. Technical Field

The present application relates to the technical field of electronic cigarettes, and in particular, to a method for controlling the output power of a power supply of an electronic cigarette and an electronic cigarette.

2. Description of the Related Art

An electronic cigarette is a product that is capable of heating tobacco tar to generate an aerosol for a user to inhale, which generally includes a power supply, a heating element, and a controller, and uses the controller to control the power supply to output power to the heating element, so that the heating element can heat and vaporize the tobacco tar according to the output power to generate the aerosol.

In the prior art, a method for controlling the output power of a power supply of an electronic cigarette has defects regarding the fast energy consumption of the power supply, uniform quantity of generated aerosols, and poor user experience.

SUMMARY

In order to resolve the foregoing technical problems, embodiments of the present application provide a method for controlling the output power of a power supply of an electronic cigarette, including the following steps:

S1: when inhalation airflow is first detected, controlling the power supply to output a first power P1 to a heating element in a first time period T1 in a first inhalation airflow flowing process, and to output a second power P2 to the heating element in a second time period T2 immediately following the first time period T1 in the first inhalation airflow flowing process, where P1>P2, and when flowing of the first inhalation airflow ends or when the power supply continuously outputs power for a time period greater than a first threshold TM, controlling the power supply to stop outputting power to the heating element; and S2: continuously detecting the inhalation airflow; and if a time interval between a time at which the inhalation airflow is detected and a time at which the power supply previously stops outputting power to the heating element is less than or equal to a second threshold TN, controlling the power supply to output a third power P3 to the heating element in the inhalation airflow flowing process, where P1>P3; or if a time interval between a time at which the inhalation airflow is detected and a time at which the power supply previously stops outputting power to the heating element is greater than the second threshold TN, controlling the power supply to output the first power P1 to the heating element in the first time period T1 in the inhalation airflow flowing process, and to output the second power P2 to the heating element in the second time period T2 immediately following the first time period T1 in the inhalation airflow flowing process, where P1>P2, and when flowing of the inhalation airflow ends or when the power supply continuously outputs power for a time period greater than the first threshold TM, controlling the power supply to stop outputting power to the heating element.

Further, the controlling method further includes the following steps: start from a moment at which the power supply stops outputting power to the heating element, when the inhalation airflow is not detected in a duration greater than a third threshold TO, controlling the electronic cigarette to enter a standby state or a turn-off state, where TO≥TN.

Further, 15 seconds≤TN≤60 seconds, preferably, 25 seconds≤TN≤40 seconds, and more preferably, TN=30 seconds.

Further, starting from a moment at which the power supply stops outputting power to the heating element, when the inhalation airflow is not detected in a duration exceeding the second threshold TN, it is determined that the time interval between the time at which the inhalation airflow is detected and the time at which the power supply previously stops outputting power to the heating element is greater than the second threshold TN, and timing is stopped.

Further, 2 seconds≤TM≤10 seconds.

Further, 6 W≤P1≤15 W, preferably, 7.2 W≤P1≤9 W; and 4.5 W≤P2≤9 W, preferably, 6 W≤P2≤8 W.

Further, 0.1 seconds≤T1≤2 seconds, preferably, 0.1 seconds≤T1≤1 second, and more preferably, 0.1 seconds≤T1≤0.6 seconds; and 0.1 seconds≤T2≤4 seconds, preferably, 0.1 seconds≤T2≤3.5 seconds.

Further, 4.5 W≤P3≤9 W, preferably, 6 W≤P3≤8 W; and more preferably, P2=P3.

Further, the first time period T1 is started for timing since a moment at which the inhalation airflow is detected.

An embodiment of the present application further provides an electronic cigarette including a controller, the controller including a processor and a memory communicatively connected to the processor; program instructions are stored in the memory; and the processor is capable of implementing, by executing the program instructions, one of the methods for controlling the output power of a power supply of an electronic cigarette.

Beneficial effects of the embodiments of the present application are as follows. According to the method for controlling the output power of a power supply of an electronic cigarette provided in the embodiments of the present application, energy of the power supply is consumed slowly, an aerosol can be generated more uniformly, and a user experience is enhanced.

DETAILED DESCRIPTION

Figure 1:
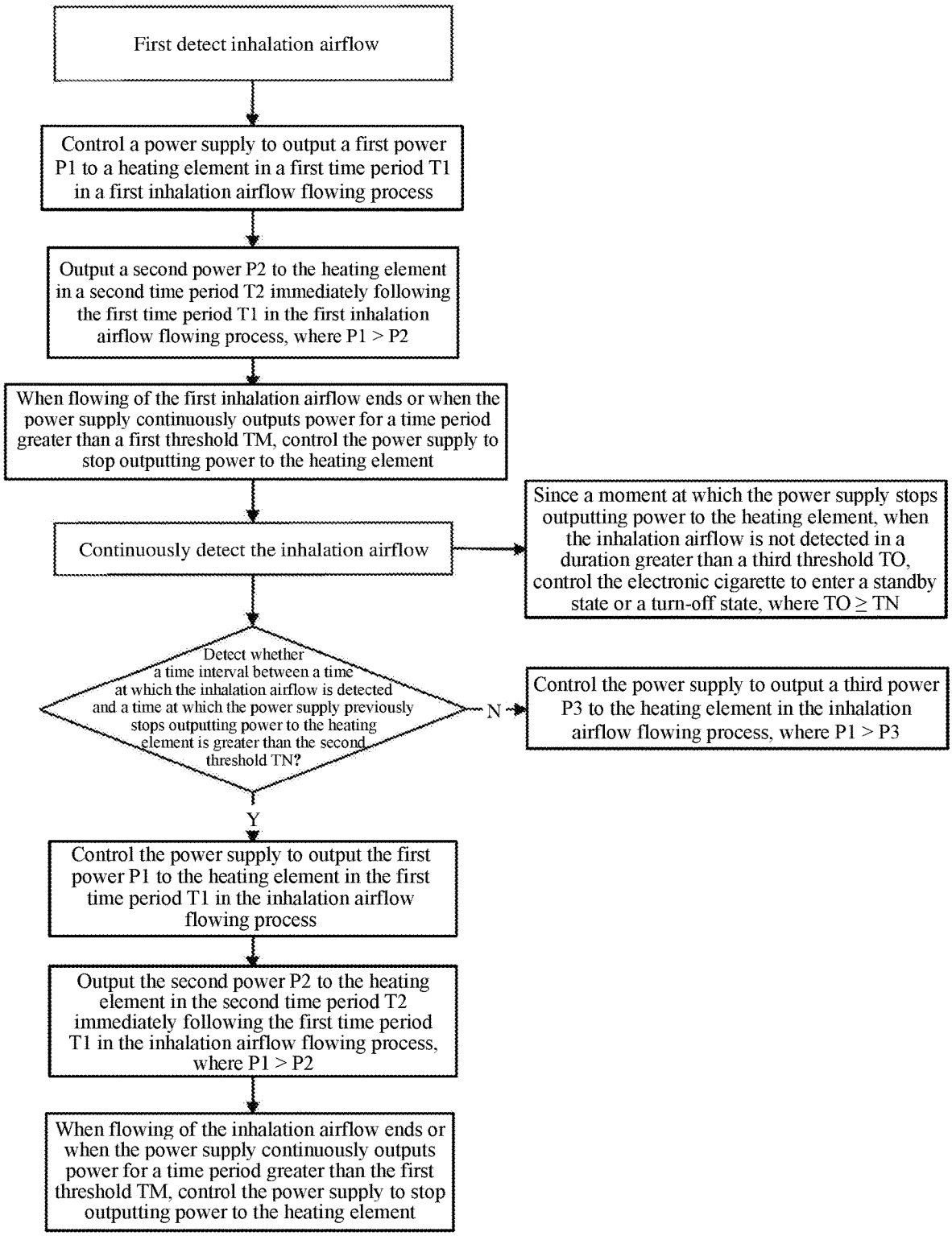
FIG. 1 is a flowchart of a method for controlling the output power of a power supply of an electronic cigarette according to an embodiment of the present application.

In order to make the objectives, technical solutions, and advantages of the present application more comprehensible, the present application is described in further detail below with reference to specific embodiments and the accompanying drawings. Those skilled in the art know that the present application is not limited to the accompanying drawings and the following embodiments.

Embodiment 1: Method for Controlling the Output Power of a Power Supply of an Electronic Cigarette Referring to FIG. 1 and FIG. 2, this embodiment provides a method for controlling the output power of a power supply of an electronic cigarette, including the following steps:

S1: when inhalation airflow is first detected, controlling the power supply to output a first power P1 to a heating element in a first time period T1 in a first inhalation airflow flowing process, and to output a second power P2 to the heating element in a second time period T2 immediately following the first time period T1 in the first inhalation airflow flowing process, where P1>P2, and when flowing of the first inhalation airflow ends or when the power supply continuously outputs power for time period greater than a first threshold TM, controlling the power supply to stop outputting power to the heating element, where 6 W≤P1≤15 W, preferably, 7.2 W≤P1≤9 W;

0.1 seconds≤T1≤2 seconds, preferably, 0.1 seconds≤T1≤1 second, and more preferably, 0.1 seconds≤T1≤0.6 seconds;

4.5 W≤P2≤9 W, preferably, 6 W≤P2≤8 W;

0.1 seconds≤T2≤4 seconds, preferably, 0.1 seconds≤T2≤3.5 seconds; and 2 seconds≤TM≤10 seconds; and S2: continuously detecting the inhalation airflow; and if a time interval between a time at which the inhalation airflow is detected and a time at which the power supply previously stops outputting power to the heating element is less than or equal to a second threshold TN, controlling the power supply to output a third power P3 to the heating element in the inhalation airflow flowing process, where P1>P3; or if a time interval between a time at which the inhalation airflow is detected and a time at which the power supply previously stops outputting power to the heating element is greater than the second threshold TN, controlling the power supply to output the first power P1 to the heating element in the first time period T1 in the inhalation airflow flowing process, and to output the second power P2 to the heating element in the second time period T2 immediately following the first time period T1 in the inhalation airflow flowing process, where P1>P2, and when flowing of the inhalation airflow ends or when the power supply continuously outputs power for a time period greater than the first threshold TM, controlling the power supply to stop outputting power to the heating element.

4.5 W≤P3≤9 W, preferably, 6 W≤P3≤8 W; more preferably, P2=P3; and 15 seconds≤TN≤60 seconds, preferably, 25 seconds≤TN≤40 seconds, and more preferably, TN=30 seconds.

Preferably, starting from a moment at which the power supply stops outputting power to the heating element, when the inhalation airflow is not detected in a duration exceeding the second threshold TN, it is determined that the time interval between the time at which the inhalation airflow is detected and the time at which the power supply previously stops outputting power to the heating element is greater than the second threshold TN. In this implementation, when the inhalation airflow is not detected in the duration exceeding the second threshold TN, timing is stopped for the electronic cigarette, so that power supply energy is saved. Because of limitation on a volume and a weight of the electronic cigarette, the electronic cigarette has a limited power capacity, saving energy is particularly important, and power supply energy consumption may be greatly reduced through this implementation.

Preferably, the controlling method further includes the following steps: starting from a moment at which the power supply stops outputting power to the heating element, when the inhalation airflow is not detected in a duration greater than a third threshold TO, controlling the electronic cigarette to enter a standby state or a turn-off state. When the electronic cigarette is in the "standby state", an inhalation sensor remains an active state, where

TO≥TN.

Preferably, the time for controlling the power supply to output power to the heating element each time is less than or equal to the first threshold TM.

Preferably, 3 seconds≤TM≤6 seconds.

Preferably, the first time period T1 is started for timing since a moment at which the inhalation airflow is detected.

The electronic cigarette is generally in a turn-off state or a standby state before being used. Each time a user uses the electronic cigarette, the electronic cigarette controls, by detecting first inhalation airflow, the power supply to output power to the heating element in a first inhalation airflow flowing process in a manner of step S1 disclosed in this embodiment, and controls the power supply to output power to the heating element during a subsequent using process in a manner of step S2. According to the method for controlling the output power of a power supply of an electronic cigarette disclosed in this embodiment, the speed of generating smoke may be increased during the first inhalation, the generated smoke is safer, and the smoke is generated uniformly in the first inhalation process and a subsequent using process, so that energy is saved.

Embodiment 2: Electronic Cigarette

Figure 2:
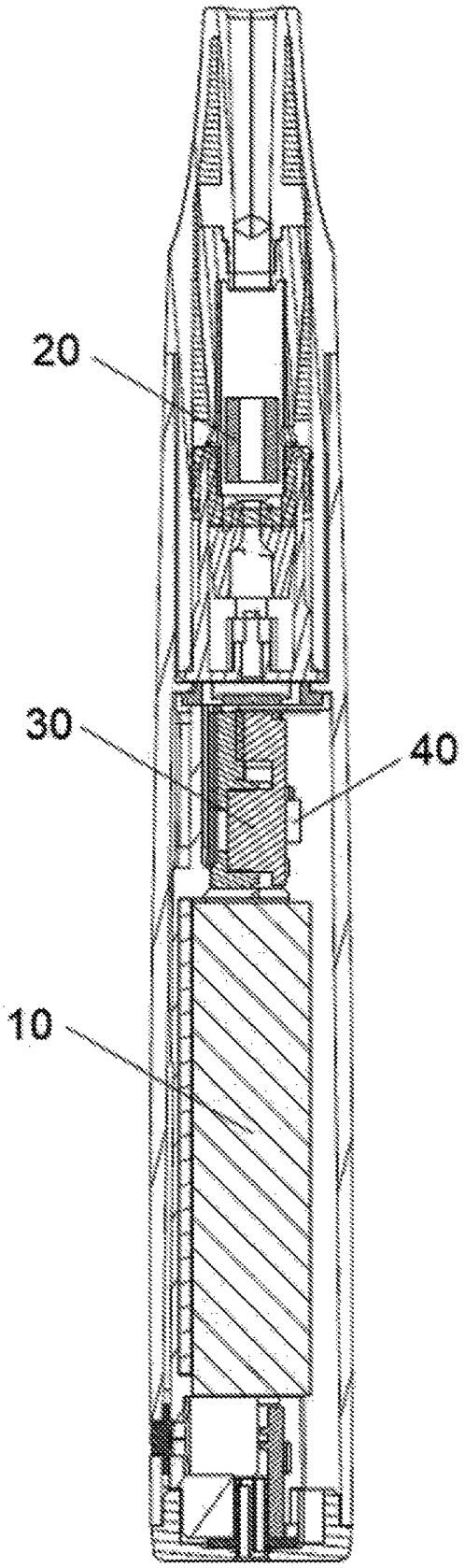
FIG. 2 is a schematic structural diagram of an electronic cigarette according to an embodiment of the present application.

Referring to FIG. 1 and FIG. 2, the electronic cigarette of the embodiment of the present application includes a power supply 10, a heating element 20, an inhalation sensor 30, and a controller 40. The power supply 10 can output power to the heating element 20, and the heating element 20 is configured to heat tobacco tar. The heating element 20 generates heat after being electrified, to heat the tobacco tar, so that the tobacco tar is vaporized, thereby generating an aerosol for the user to inhale.

The inhalation sensor 30 is configured to detect inhalation airflow, for example, an airflow sensor. The inhalation sensor generates a detection signal when the inhalation airflow is detected, and the controller 40 can obtain the detection signal and uses the detection signal to control the power supply of the electronic cigarette to output power to the heating element 20.

In the implementation of the present application, the controller 40 can perform the method for controlling the output power of a power supply of an electronic cigarette provided in Embodiment 1, and control, according to the controlling method, the power supply 10 to output power to the heating element 20. Details are as follows:

S1: When the inhalation sensor 30 first detects inhalation airflow, the inhalation sensor 30 generates a detection signal that represents first detected inhalation airflow. The controller 40 obtains the detection signal, and the controller 40 controls the power supply 10 to output a first power P1 to a heating element 20 in a first time period T1 in a first inhalation airflow flowing process, and to output a second power P2 to the heating element 20 in a second time period T2 immediately following the first time period T1 in the first inhalation airflow flowing process, where P1>P2, and when flowing of the first inhalation airflow ends or when the power supply 10 continuously outputs power for a time greater than a first threshold TM, the controller 40 controls the power supply 10 to stop outputting power to the heating element 20, where 6 W≤P1≤15 W, preferably, 7.2 W≤P1≤9 W;

0.1 seconds≤T1≤2 seconds, preferably, 0.1 seconds≤T1≤1 second, and more preferably, 0.1 seconds≤T1≤0.6 seconds;

4.5 W≤P2≤9 W, preferably, 6 W≤P2≤8 W;

0.1 seconds≤T2≤4 seconds, preferably, 0.1 seconds≤T2≤3.5 seconds; and 2 seconds≤TM≤10 seconds.

S2: The inhalation sensor 30 continuously detects the inhalation airflow, the inhalation sensor 30 generates the detection signal that represents the first detected inhalation airflow, and the controller 40 obtains the detection signal. If a time interval between a time at which the inhalation sensor 30 detects the inhalation airflow and a time at which the power supply 10 previously stops outputting power to the heating element 20 is less than or equal to a second threshold TN, the controller 40 controls the power supply 10 to output a third power P3 to the heating element 20 in the inhalation airflow flowing process, where P1>P3; or if the time interval between the time at which the inhalation sensor 30 detects the inhalation airflow and the time at which the power supply 10 previously stops outputting power to the heating element 20 is greater than the second threshold TN, the controller 40 controls the power supply 10 to output the first power P1 to the heating element 20 in the first time period T1 in the inhalation airflow flowing process, and to output the second power P2 to the heating element in the second time period T2 immediately following the first time period T1 in the inhalation airflow flowing process, where P1>P2, and when flowing of the inhalation airflow ends or when the power supply continuously outputs power for a time period greater than the first threshold TM, the power supply is controlled to stop outputting power to the heating element, where 4.5 W≤P3≤9 W, preferably, 6 W≤P3≤8 W; more preferably, P2=P3; and 15 seconds≤TN≤60 seconds, preferably, 25 seconds≤TN≤40 seconds, and more preferably, TN=30 seconds.

Preferably, starting from a moment at which the power supply 10 stops outputting power to the heating element 20, when the inhalation airflow is not detected in a duration greater than the second threshold TN, it is determined that the time interval between the time at which the inhalation airflow is detected and the time at which the power supply 10 previously stops outputting power to the heating element 20 is greater than the second threshold TN, and timing is stopped. In this implementation, when the inhalation airflow is not detected in the duration greater than the second threshold TN, timing is stopped for the electronic cigarette, so that power supply energy is saved. Because of limitation on a volume and a weight of the electronic cigarette, the electronic cigarette has limited power capacity, saving energy is particularly important, and power supply energy consumption may be greatly reduced through this implementation.

Preferably, the controlling method further includes the following steps. Starting from a moment at which the power supply 10 stops outputting power to the heating element 20, when the inhalation airflow is not detected in a duration greater than a third threshold TO, the controller controls the electronic cigarette to enter a standby state or a turn-off state, and the inhalation sensor remains an active state when the electronic cigarette is in the "standby state", where

TO≥TN.

Preferably, the time for controlling the power supply 10 to output power to the heating element each time is less than or equal to the first threshold TM.

Preferably, 3 seconds≤TM≤6 seconds.

Preferably, the first time period T1 is started for timing since a moment at which the inhalation airflow is detected.

By using the method for controlling the output power of a power supply of an electronic cigarette preferred in this embodiment, the speed of generating smoke may be increased during the first inhalation, the generated smoke is safer, and the smoke is generated uniformly in a first inhalation process and a subsequent using process, so that energy is saved.

Embodiment 3: Electronic Cigarette

The embodiment provides an electronic cigarette including a controller, the controller including a processor and a memory communicatively connected to the processor. Program instructions are stored in the memory, and the processor is capable of implementing, by executing the program instruction, the method for controlling the output power of a power supply of an electronic cigarette.

The technical effects of the embodiments of the present application are described below.

Due to factors such as user habits or types of tobacco tar, different users generally have different first inhalation durations during the first inhalation. In view of the user experience, the heating element should be heated up quickly during the first inhalation to increase the speed of initially generating smoke. But if the temperature rises excessively fast, the temperature is too high, and the temperature of a vaporized tobacco tar is too high, a risk of burning the user and damaging the electronic cigarette would be caused. Based on this, in the embodiments of the present application, a time period for the initial inhalation is divided, including at least a first time period and a second time period. In the first time period, the power supply is controlled to output a high power to enable the heating element to be heated up quickly and accelerate the startup process, which is beneficial to vaporize the tobacco tar in a relatively short time and generate required aerosols. In the second time period, the power supply is controlled to output a lower power to save electric energy and prolong the service time of the power supply. In a third time period and each time period obtained after retiming, because the heat of the heating element is not completely dissipated, the power supply is controlled to output lower power, which is beneficial to save electric energy. When each of inhalation duration reaches a threshold, the power supply is controlled not to output power, which improves the safety of the electronic cigarette and protects the electronic cigarette from being damaged, and thus the user is protected from being damaged.

The implementations of the present application are described above. However, the present application is not limited to the implementations. Any modification, equivalent replacement, or improvement made within the spirit and principle of the present disclosure shall fall within the protection scope of the present disclosure.

What is claimed is:

1. A method for controlling the output power of a power supply of an electronic cigarette, comprising the following steps:

S1: when inhalation airflow is first detected, controlling the power supply to output a first power P1 to a heating element in a first time period T1 in a first inhalation airflow flowing process, and to output a second power P2 to the heating element in a second time period T2 immediately following the first time period T1 in the first inhalation airflow flowing process, wherein P1>P2, and when flowing of the first inhalation airflow ends or when the power supply continuously outputs power for a time period greater than a first threshold TM, controlling the power supply to stop outputting power to the heating element; and S2: continuously detecting the inhalation airflow; and if a time interval between a time at which the inhalation airflow is detected and a time at which the power supply previously stops outputting power to the heating element is less than or equal to a second threshold TN, controlling the power supply to output a third power P3 to the heating element in the inhalation airflow flowing process, wherein P1>P3; or if a time interval between a time at which the inhalation airflow is detected and a time at which the power supply previously stops outputting power to the heating element is greater than the second threshold TN, controlling the power supply to output the first power P1 to the heating element in the first time period T1 in the inhalation airflow flowing process, and to output the second power P2 to the heating element in the second time period T2 immediately following the first time period T1 in the inhalation airflow flowing process, wherein P1>P2, and when flowing of the inhalation airflow ends or when the power supply continuously outputs power for a time period greater than the first threshold TM, controlling the power supply to stop outputting power to the heating element.

2. The method for controlling the output power of a power supply of an electronic cigarette according to claim 1, wherein the controlling method further comprises the following steps:

starting from a moment at which the power supply stops outputting power to the heating element, when the inhalation airflow is not detected in a duration greater than a third threshold TO, controlling the electronic cigarette to enter a standby state or a turn-off state, wherein TO≥TN.

3. The method for controlling the output power of a power supply of an electronic cigarette according to claim 1, wherein 15 seconds≤TN≤60 seconds.

4. The method for controlling the output power of a power supply of an electronic cigarette according to claim 1, wherein 25 seconds≤TN≤40 seconds.

5. The method for controlling the output power of a power supply of an electronic cigarette according to claim 1, wherein TN=30 seconds.

6. The method for controlling the output power of a power supply of an electronic cigarette according to claim 1, wherein starting from a moment at which the power supply stops outputting power to the heating element, when the inhalation airflow is not detected in a duration exceeding the second threshold TN, determining that the time interval between the time at which the inhalation airflow is detected and the time at which the power supply previously stops outputting power to the heating element is greater than the second threshold TN, and stopping timing.

7. The method for controlling the output power of a power supply of an electronic cigarette according to claim 1, wherein 2 seconds≤TM≤10 seconds.

8. The method for controlling the output power of a power supply of an electronic cigarette according to claim 1, wherein 6 W≤P1≤15 W; and 4.5 W≤P2≤9 W.

9. The method for controlling the output power of a power supply of an electronic cigarette according to claim 1, wherein 7.2 W≤P1≤9 W; and 6 W≤P2≤8 W.

10. The method for controlling the output power of a power supply of an electronic cigarette according to claim 1, wherein 0.1 seconds≤T1≤2 seconds; and 0.1 seconds≤T2≤4 seconds.

11. The method for controlling the output power of a power supply of an electronic cigarette according to claim 1, wherein 0.1 seconds≤T1≤1 second; and 0.1 seconds≤T2≤3.5 seconds.

12. The method for controlling the output power of a power supply of an electronic cigarette according to claim 1, wherein 0.1 seconds≤T1≤0.6 second; and 0.1 seconds≤T2≤3.5 seconds.

13. The method for controlling the output power of a power supply of an electronic cigarette according to claim 1, wherein 4.5 W≤P3≤9 W.

14. The method for controlling the output power of a power supply of an electronic cigarette according to claim 1, wherein 6 W≤P3≤8 W.

15. The method for controlling the output power of a power supply of an electronic cigarette according to claim 1, wherein P2=P3.

16. The method for controlling the output power of a power supply of an electronic cigarette according to claim 1, wherein the first time period T1 is started for timing since a moment at which the inhalation airflow is detected.

17. An electronic cigarette comprising a controller, wherein the controller comprises a processor and a memory communicatively connected to the processor; program instructions are stored in the memory;

and the processor is capable of implementing, by executing the program instructions, a method for controlling output power of a power supply of an electronic cigarette comprising:

S1: when inhalation airflow is first detected, controlling the power supply to output a first power P1 to a heating element in a first time period T1 in a first inhalation airflow flowing process, and to output a second power P2 to the heating element in a second time period T2 immediately following the first time period T1 in the first inhalation airflow flowing process, wherein P1>P2, and when flowing of the first inhalation airflow ends or when the power supply continuously outputs power for a time period greater than a first threshold TM, controlling the power supply to stop outputting power to the heating element; and S2: continuously detecting the inhalation airflow; and if a time interval between a time at which the inhalation airflow is detected and a time at which the power supply previously stops outputting power to the heating element is less than or equal to a second threshold TN, controlling the power supply to output a third power P3 to the heating element in the inhalation airflow flowing process, wherein P1>P3; or if a time interval between a time at which the inhalation airflow is detected and a time at which the power supply previously stops outputting power to the heating element is greater than the second threshold TN, controlling the power supply to output the first power P1 to the heating element in the first time period T1 in the inhalation airflow flowing process, and to output the second power P2 to the heating element in the second time period T2 immediately following the first time period T1 in the inhalation airflow flowing process, wherein P1>P2, and when flowing of the inhalation airflow ends or when the power supply continuously outputs power for a time period greater than the first threshold TM, controlling the power supply to stop outputting power to the heating element.

18. The electronic cigarette according to claim 17, wherein the controlling method further comprises the following steps:

starting from a moment at which the power supply stops outputting power to the heating element, when the inhalation airflow is not detected in a duration greater than a third threshold TO, controlling the electronic cigarette to enter a standby state or a turn-off state, wherein TO≥TN.

19. The electronic cigarette according to claim 17, wherein the controlling method further comprises the following steps:

starting from a moment at which the power supply stops outputting power to the heating element, when the inhalation airflow is not detected in a duration exceeding the second threshold TN, determining that the time interval between the time at which the inhalation airflow is detected and the time at which the power supply previously stops outputting power to the heating element is greater than the second threshold TN, and stopping timing.

20. The electronic cigarette according to claim 17, wherein the first time period T1 is started for timing since a moment at which the inhalation airflow is detected.

* * * * *